US010905922B2

(12) United States Patent
Dolezel

(10) Patent No.: US 10,905,922 B2
(45) Date of Patent: Feb. 2, 2021

(54) GOLF CLUB HEAD INDICIA AND METHODS OF GENERATING THE SAME

(71) Applicant: DUNLOP SPORTS CO. LTD., Kobe (JP)

(72) Inventor: Keith F. Dolezel, Huntington Beach, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 184 days.

(21) Appl. No.: 15/611,111

(22) Filed: Jun. 1, 2017

(65) Prior Publication Data

US 2018/0345092 A1 Dec. 6, 2018

(51) Int. Cl.

| | |
|---|---|
| ***A63B 53/04*** | (2015.01) |
| ***B24C 1/04*** | (2006.01) |
| ***B24C 1/10*** | (2006.01) |
| ***B24C 1/06*** | (2006.01) |

(52) U.S. Cl.

CPC ..... *A63B 53/0466* (2013.01); *B24C 1/04* (2013.01); *B24C 1/06* (2013.01); *B24C 1/10* (2013.01); *A63B 53/0437* (2020.08); *A63B 53/0445* (2020.08)

(58) Field of Classification Search

CPC ..... A63B 53/0466; A63B 2053/0408; A63B 2053/0437

USPC ..... 473/324–350, 287–292, 219–256, 473/313–314

See application file for complete search history.

(56) References Cited

U.S. PATENT DOCUMENTS

| | | | | |
|---|---|---|---|---|
| 4,323,423 | A * | 4/1982 | Schrunk | B44C 1/221 216/31 |
| 6,551,195 | B2 * | 4/2003 | Byrne | A63B 69/3688 473/200 |
| 6,719,644 | B2 * | 4/2004 | Beach | A63B 53/04 473/330 |
| 7,077,757 | B1 * | 7/2006 | Payne | A63B 53/04 473/238 |
| 7,607,989 | B2 * | 10/2009 | Hess | G09F 23/0066 473/282 |

(Continued)

FOREIGN PATENT DOCUMENTS

WO 1993/010697 A1 6/1993

OTHER PUBLICATIONS

Aswan, "Audi Figures Out How to Etch Symbols in Paint", Auto News, Jan. 26, 2017, pp. 1-3.

*Primary Examiner* — Sebastiano Passaniti
(74) *Attorney, Agent, or Firm* — Oliff PLC

(57) ABSTRACT

A golf club head includes a striking face, and a bottom portion secured to, and extending rearward of, the striking face. A top portion of the golf club head is secured to, and extends rearward of, the striking face. The top portion includes a substrate layer and a sealant layer disposed on the substrate layer. The sealant layer includes therein a roughened region defining visually identifiable indicia. According to another aspect, a method includes receiving a golf club head including a portion having a metal substrate layer and a sealant layer disposed thereon. A selection of a first indicia is received from among a plurality of indicia, and a masking is applied to one or more exterior surface regions of the portion based on the selection. A visual representation of the first indicia is generated on an exterior surface of the portion by media blasting the portion.

10 Claims, 3 Drawing Sheets

(56) References Cited

U.S. PATENT DOCUMENTS

| | | | | |
|---|---|---|---|---|
| 8,663,025 | B2 * | 3/2014 | Barrett | A63B 69/3632 473/200 |
| 8,771,095 | B2 * | 7/2014 | Beach | A63B 53/04 473/226 |
| 8,827,836 | B2 * | 9/2014 | Thomas | A63B 53/0466 473/345 |
| 9,533,202 | B2 * | 1/2017 | Blevins | A63B 53/08 |
| 2002/0183133 | A1 * | 12/2002 | Sano | A63B 53/04 473/324 |
| 2003/0017885 | A1 * | 1/2003 | Heene | A63B 53/04 473/324 |
| 2014/0022390 | A1 * | 1/2014 | Blank | B60R 1/12 348/148 |
| 2014/0274446 | A1 * | 9/2014 | Greaney | A63B 53/0466 473/307 |
| 2015/0022994 | A1 * | 1/2015 | Bingle | G01D 13/20 362/23.01 |
| 2016/0067558 | A1 * | 3/2016 | Trahan | A63B 53/04 473/349 |
| 2016/0129321 | A1 * | 5/2016 | Dolezel | A63B 53/0487 473/340 |
| 2017/0014688 | A1 * | 1/2017 | Dolezel | A63B 53/02 |
| 2017/0087928 | A1 * | 3/2017 | Adachi | B44F 9/02 |

* cited by examiner

GOLF CLUB HEAD INDICIA AND METHODS OF GENERATING THE SAME

BACKGROUND

Golf club heads often include visual indicia or designs for various reasons. Such reasons may include ornamental or aesthetic reasons, functional reasons as with a golf ball alignment indicator, or insignia reasons such as branding. Typically, these indicia or designs are painted onto a golf club head into a recess formed in the golf club head to contain the paint. In some cases, decals may be applied to a golf club head to provide indicia or designs. After applying paint or a decal to the golf club head, a sealant or other coating (e.g., a clearcoat) is usually applied to the golf club head for wear resistance of the indicia and for the golf club head itself.

However, using paint or decals to apply indicia or designs to a golf club head can be problematic. In the case of painting a golf club head, the forming of a recess to contain the paint can deleteriously affect mass properties and/or the structural integrity of the golf club head, particularly for recesses in high stress regions of the golf club head. In the case of decals, applying a decal to an arcuate surface on a golf club head can be difficult to properly place. In addition, each of these methods of adding indicia to a golf club head can be costly in terms of time and material when manufacturing a large number of golf club heads. The indicia are also generally permanent after the sealant or final coating has been applied over the paint or decal.

BRIEF DESCRIPTION OF THE DRAWINGS

The features and advantages of the embodiments of the present disclosure will become more apparent from the detailed description set forth below when taken in conjunction with the drawings. The drawings and the associated descriptions are provided to illustrate embodiments of the disclosure and not to limit the scope of what is claimed.

DETAILED DESCRIPTION

In the following detailed description, numerous specific details are set forth to provide a full understanding of the present disclosure. It will be apparent, however, to one of ordinary skill in the art that the various embodiments disclosed may be practiced without some of these specific details. In other instances, well-known structures and techniques have not been shown in detail to avoid unnecessarily obscuring the various embodiments.

Figure 1A:
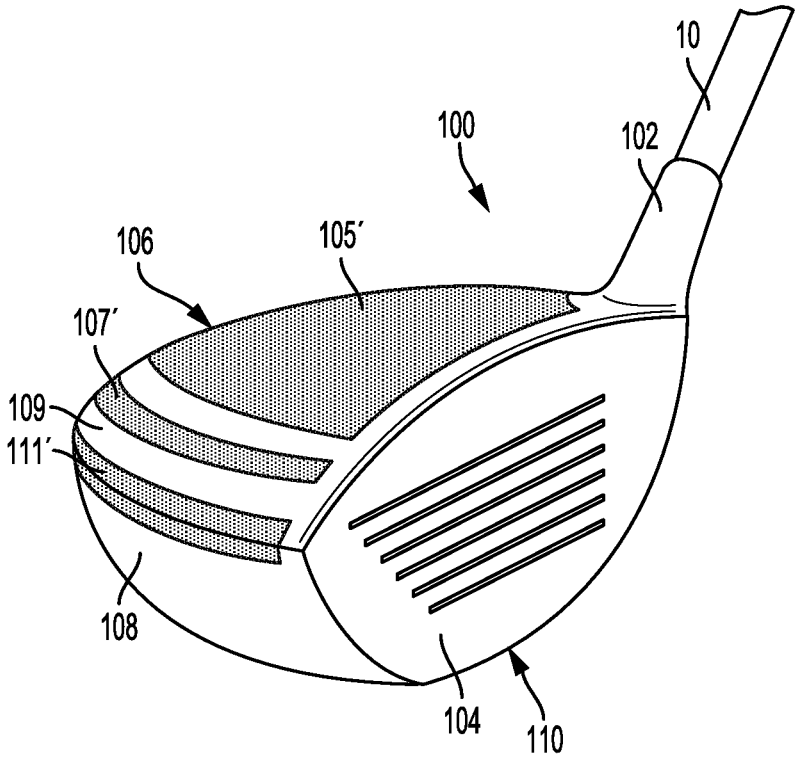
FIG. 1A is a perspective view of a golf club head including indicia according to an embodiment.
Figure 1B:
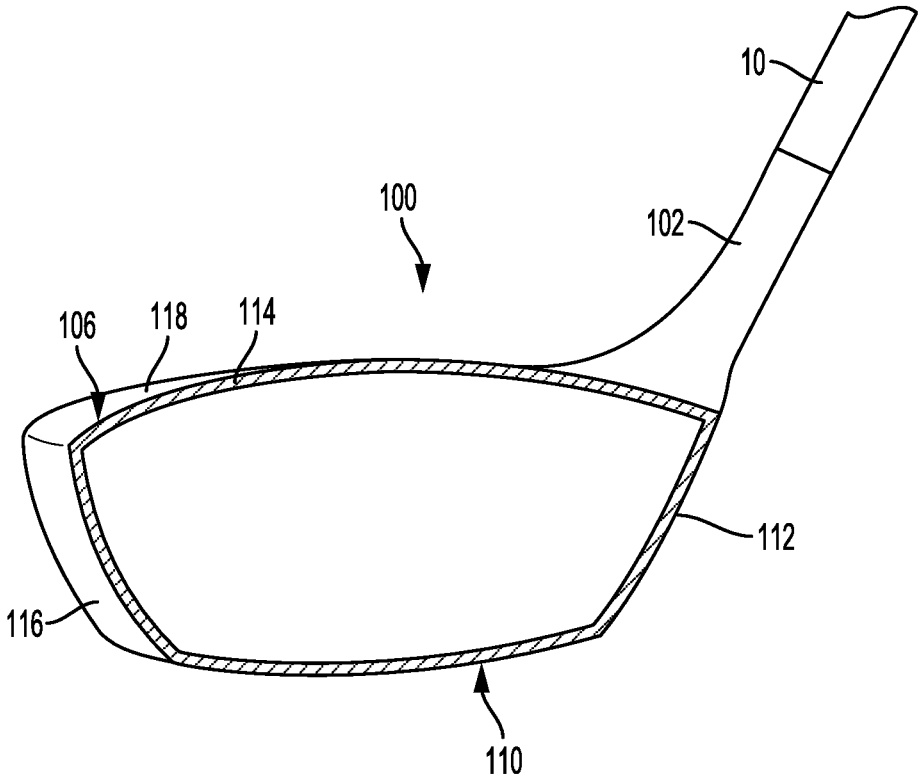
FIG. 1B is a cross-section view of the golf club head of FIG. 1A.

FIGS. 1A and 1B provide a perspective view and a cross-section view, respectively, of a wood-type golf club head (e.g., a fairway wood or driver wood) according to an embodiment. As shown in FIG. 1A, golf club head 100 includes roughened regions 105', 107', and 111' defining visually identifiable indicia, which may also be referred to as a design. As will be appreciated by those of ordinary skill in the art when reading the present disclosure, the disclosed golf club head indicia and methods of generating the same can be applied to other types of golf club heads, such as an iron-type, putter-type, wedge-type, chipper-type, or hybrid wood and iron type golf club head.

As shown in FIGS. 1A and 1B, golf club head 100 is secured to golf shaft 10 via hosel 102 of golf club head 100. Golf club head 100 includes striking face 104 for striking a golf ball. Striking face 104 can include texture features, bulge, roll, scorelines and/or grooves for increasing spin on a golf ball when hitting the golf ball, and for retaining moisture from the golf ball. Bottom portion 110, is secured to, and extends rearward of, striking face 104. In the example of FIGS. 1A and 1B, bottom portion 110 can be referred to as the sole of golf club head 100. In addition, top portion 106 is secured to, and extends rearward of, striking face 104.

As shown in the cross-section view of FIG. 1B, top portion 106 includes crown section 118, toe section 116, and heel section 112. In the example of FIG. 1B, golf club head 100 is a hollow-type golf club head with a void space interior of substrate layer 114. For its part, substrate layer 114 can include, for example, a metal material such as titanium or a titanium alloy. In other embodiments, golf club head 100 may be solid (e.g., solid wood) or include other components, mass elements, stiffening features, and/or partitions inside golf club head 100.

As shown in FIG. 1A, top portion 106 includes roughened regions 105', 107', and 111' that define visually identifiable indicia on top portion 106 by visually contrasting with smooth regions 109 and 108 of crown section 118 and toe section 116, respectively. In other embodiments, visually identifiable indicia may alternatively or additionally be defined on other sections of top portion 106 or golf club head 100, such as by including roughened regions on heel section 112 or hosel 102.

In the example of FIG. 1A, the indicia defined on top portion 106 by roughened regions 105', 107', and 111' can serve an ornamental purpose, a branding purpose, and/or a functional purpose, such as by helping a golfer align a golf ball with a sweet spot, face center, or other intended ideal impact point on striking face 104. In other examples, the indicia defined by roughened regions on a golf club head may alternatively or additionally serve to indicate a latent or apparent property of the golf club head, such as a center of gravity location, a designation of loft angle, lie angle, bounce angle, volume, a location of internal masses, and/or variable thickness regions of top portion 106. In addition, the indicia defined by roughened regions on a golf club head may be used to provide insignia indicating ownership of the golf club or branding of a golf club manufacturer.

Figure 1C:
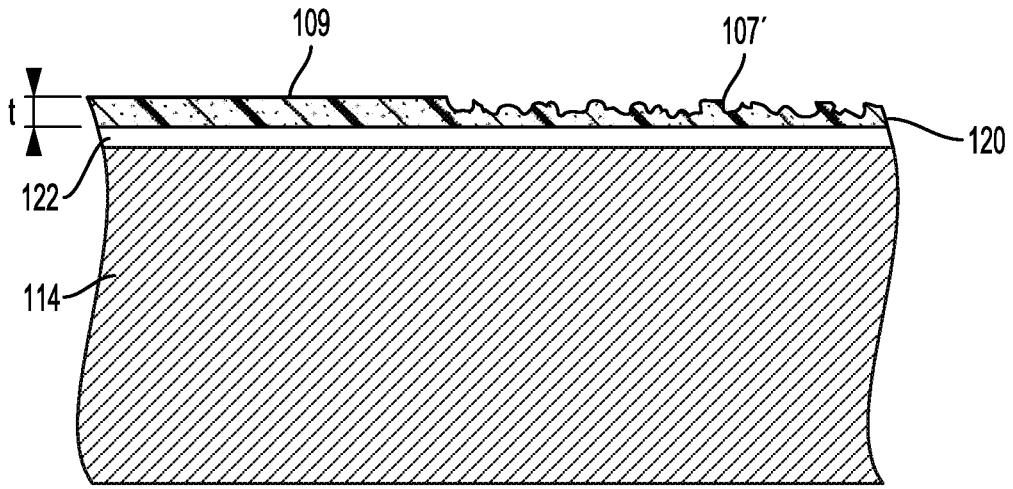
FIG. 1C is a closeup cross-section view of a sealant layer disposed on a substrate layer of the golf club head of FIGS. 1A and 1B.

FIG. 1C is a closeup cross-section view of sealant layer 120 disposed on substrate layer 114 of top portion 106. In more detail, the cross-section view of FIG. 1C shows smooth region 109 and roughened region 107' in sealant layer 120 disposed on substrate layer 114 of top portion 106. As shown in FIG. 1C, paint layer 122 disposed on substrate layer 114 is covered by sealant layer 120. In some implementations, one or more paint layers can be included in paint layer 122, such as a primer coat and one or more basecoats including, for example, solid paint, metallic paint, and/or pearlescent paint. In alternative embodiments, paint layer 122 may be omitted, to allow an outer surface of substrate layer 114 to be visible, such as a metallic surface of substrate layer 114, with sealant layer 120 directly contacting substrate layer 114. In yet other embodiments, sealant layer 120 may actually be a paint layer or include a paint layer such that separate paint layer 122 is not needed and the roughened regions in sealant layer 120 are actually in a paint layer. In yet other embodiments, alternative or additional intermediate layers are located between the sealant layer 120 and the substrate layer 114, such as an anodized layer, a physical vapor deposition (PVD) layer, an oxidized layer, a nitride layer, or a chrome-plated layer.

In the example embodiment of FIG. 1C, sealant layer 120 covers paint layer 122 to provide wear resistance against physical contact (e.g., scratching) or other protection for golf club head 100, such as moisture protection (e.g., corrosion protection) and/or ultra-violet protection (e.g., sun damage protection). In addition, and as discussed in more detail below, roughened regions 105', 107', and 111' in sealant layer 120 provide visually identifiable indicia on golf club head 100.

Sealant layer 120 may include, for example, a clearcoat, sealant, paint, or other type of protective coating. In some implementations, sealant layer 120 may include, for example, xylene or a similar material. In addition, sealant layer 120 in some implementations can include multiple sealant layers or coatings. As shown in FIG. 1C, sealant layer 120 comprises a thickness t. In some implementations, the thickness, t, of sealant layer 120 is no greater than (i.e., less than or equal to) 200 μm and no less than (i.e., greater than or equal to) 20 μm, preferably between 40 μm and 200 μm, more preferably between 40 μm and 120 μm, and even more preferably between 40 μm and 60 μm.

Roughened region 107' in sealant layer 120 and other roughened regions in sealant layer 120, such as roughened regions 105' and 111', can comprise an ASME standard maximum height Ry such that Ry is no greater than the product of 0.6×t. In some implementations, roughened regions 105', 107', and 111' can comprise a maximum height Ry that is less than 60 μm. In addition, roughened region 107' in sealant layer 120 and other roughened regions in sealant layer 120 can comprise an ASME standard average surface roughness Ra in some implementations of no less than 10 μm, preferably no less than 20 μm, and even more preferably no less than 40 μm. As discussed in more detail below with reference to the indicia generation process of FIG. 2, roughened regions 105', 107', and 111' can be formed or generated by media blasting or otherwise abrading golf club head 100. Unless otherwise provided, all ASME standard surface parameters are understood as defined and measured under conditions and procedures set forth by the ASME for example as laid out in Standard ASME B46.1-2009 ("Surface Texture (Surface Roughness, Waviness, and Lay)").

Figure 2:
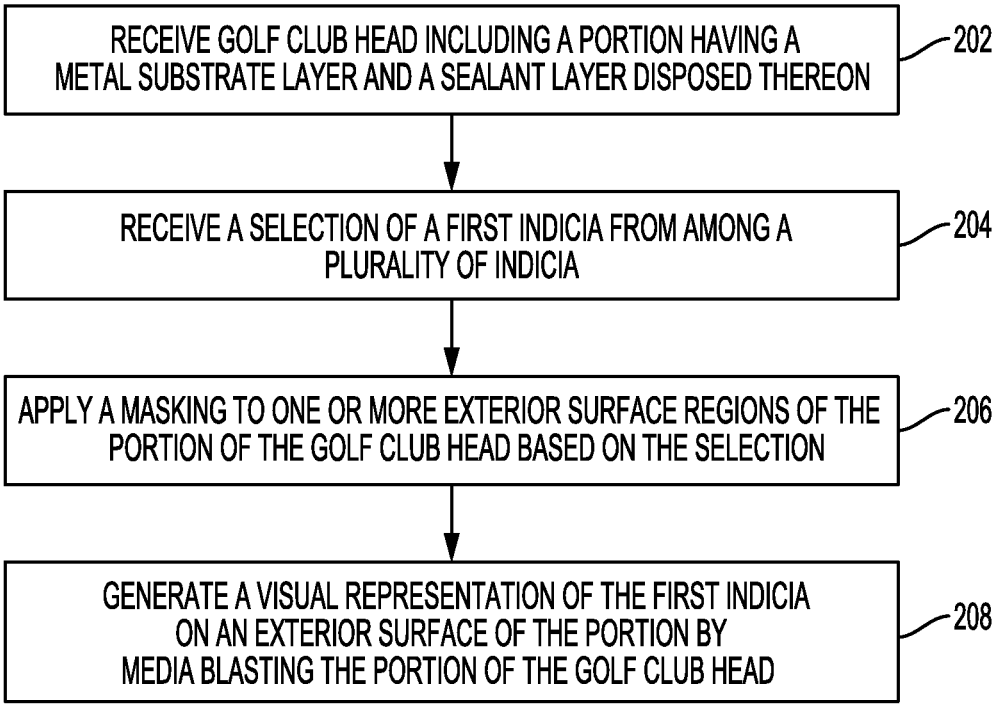
FIG. 2 is a flowchart for an indicia generation process according to an embodiment.

FIG. 2 is a flowchart for an indicia generation process according to an embodiment. The process of FIG. 2 may be performed at, for example, a manufacturing facility of a golf club manufacturer, or at a downstream location such as at a retailer or golf tournament booth, or at a combination of locations. In this regard, the indicia generation process of FIG. 2 may be used to mass produce indicia on golf club heads or may be used to apply a custom design after the golf club head has left the manufacturer. The indicia generation process of FIG. 2 is described below with references to example components of golf club head 100 described above, but those of ordinary skill in the art will appreciate that the indicia generation process of FIG. 2 is not limited to a particular golf club head or to a particular type of golf club head. As noted above, the disclosed methods of generating golf club head indicia can be performed with different types of golf club heads, such as a wood-type, an iron-type, a putter-type, a wedge-type, a chipper-type, or a hybrid wood and iron type golf club head.

In step 202, a golf club head is received including a portion having a metal substrate layer (e.g., substrate layer 114) and a sealant layer (e.g., sealant layer 120) disposed thereon. In some implementations, the metal substrate layer can comprise titanium or a titanium alloy. In addition, the sealant layer can include, for example, a clearcoat, sealant, paint, or other type of protective coating. In some implementations, sealant layer 120 may include, for example, xylene or a similar material. Sealant layer 120 in some implementations can include multiple sealant layers or coatings.

In step 204, a selection of a first indicia from among a plurality of indicia is received. The plurality of indicia may include, for example, one or more designs and/or indicators for ornament, branding, alignment, center of gravity location, loft angle, lie angle, bounce angle, volume, internal mass locations, variable thickness regions, ownership, and/or personalization.

In step 206, a masking is applied to one or more exterior surface regions of the portion of the golf club head based on the selection in step 204. The masking, for example, may include applying a masking tape, a pattern cut into a masking sheet, a vinyl decal, or other temporary masking applied or adhered to the portion of the golf club head. The masking preferably bears the characteristic of preventing media blast from deforming or non-negligibly affecting the exterior surface region to which it is attached or adhered.

Figure 3A:
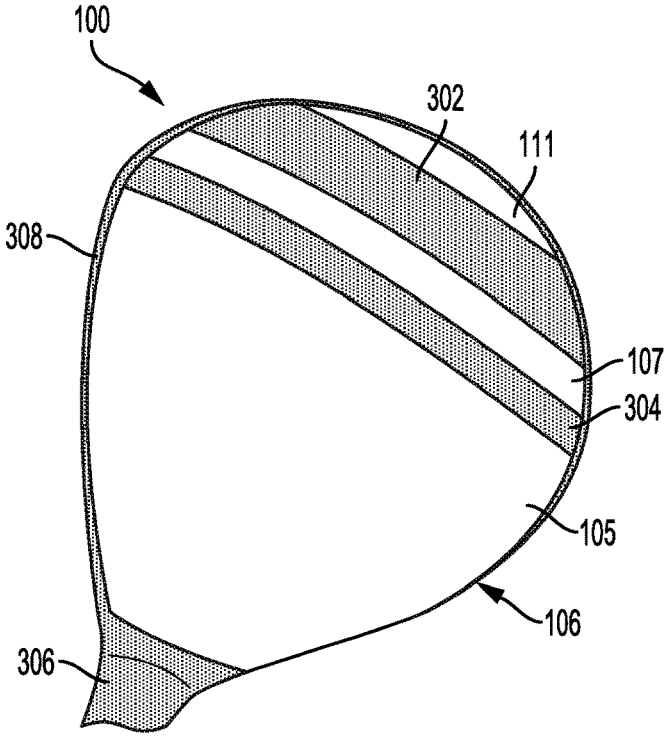
FIG. 3A is a top view of a golf club head after applying a masking to exterior surface regions of a golf club head when performing the indicia generation process of FIG. 2.

FIG. 3A provides an example of a top view of golf club head 100 after applying a masking to exterior surface regions 108 and 109 of golf club head 100. As shown in FIG. 3A, masking portions 302, 304, 306, and 308 have been applied to top portion 106 of golf club head 100. Regions 105, 107, and 111 have been left unmasked or uncovered to allow for the roughening of these regions to define visually identifiable indicia when contrasted with the unroughened regions protected by the masking portions.

Returning to the process of FIG. 2, a visual representation of the first indicia is generated in step 208 on an exterior surface of the portion of the golf club head by media blasting or abrading the portion. In some implementations, the golf club head can be placed into an abrasive blasting cabinet for media blasting. The media blasting may be carried out using media having a certain hardness, such as a MOH hardness no greater than 6.0. For example, the media blasting can be carried out using media such as glass beads, crushed glass, plastic media, or agri-shell media. The blast pressure may be, for example, no greater than 60 psi. In some embodiments, the roughened region constitutes a direct representation of an intended indicia. However, it is also contemplated that one or more roughened regions, as may be formed in step 208 may indirectly define an intended indicia by virtue of the manner in which it bounds one or more smooth regions.

Figure 3B:
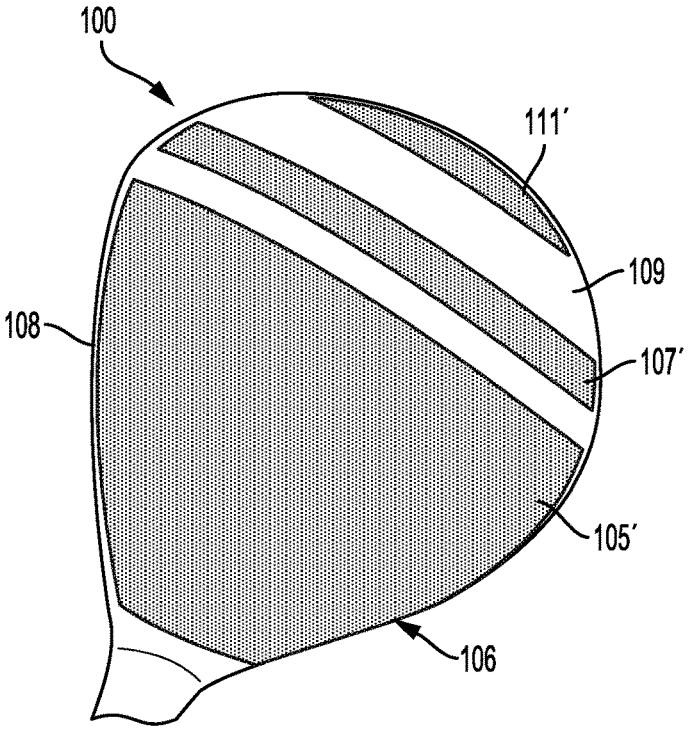
FIG. 3B is a top view of the golf club head of FIG. 3A after media blasting the golf club head.

FIG. 3B is a top view of golf club head 100 from FIG. 3A after media blasting top portion 106. As shown in FIG. 3B, unmasked or exposed regions 105, 107, and 111 have been roughened by the media blasting of step 208 to form roughened regions 105', 107', and 111'. The masked regions 108 and 109 covered by masking portions 302, 304, 306, and 308 remain smooth in comparison to roughened regions 105', 107', and 111'. In some implementations, the roughening of sealant layer 120 in regions 105', 107', and 111' can provide a dull or matte finish as compared to a glossy or smooth finish of regions 108 and 109.

Sealant layer 120 may comprise a thickness, t, that is no greater than 200 μm and no less than 20 μm, preferably between 40 μm and 200 μm, more preferably between 40 μm and 120 μm, and even more preferably between 40 μm and 60 μm. Roughened regions 105', 107', and 111' in sealant layer 120 can comprise a standard maximum height Ry such that Ry is no greater than the product of 0.6×t. In some implementations, roughened regions 105', 107', and 111' can comprise a maximum height Ry that is less than 60 μm. In addition, the average surface roughness Ra in some implementations can be no less than 10 μm, preferably no less than 20 μm, and even more preferably no less than 40 μm. Such parameters ensure as a threshold matter sufficient durability for withstanding typical wear during use while minimizing unnecessary production costs. In addition, such preferential parameters enable the particular benefits of the process of FIG. 2 in that indicia formed in this manner may be renewed, modified, or removed as will be discussed below in more detail.

In some cases, the indicia generation process of FIG. 2 may be performed more than once to apply new or additional indicia at different times onto the golf club head, or to modify previously generated indicia. For example, a golf club may be manufactured using the indicia process of FIG. 2 and a golfer may later have a retailer add personalized indicia (e.g., a nickname) after purchasing the golf club. Such reapplication of indicia is typically very difficult to do with conventional indicia such as paint or decals, which may require striping coatings or paint.

In addition, the above described methods for generating indicia ordinarily involve a simpler and lower cost process with less waste, less raw materials (e.g., no additional paint or decals), and an easier cleanup. The foregoing golf club head indicia and indicia generation methods also do not require forming a recess to contain paint or a decal. As a result, it is ordinarily possible to avoid complicating or adversely affecting the design of a golf club head to account for changes in mass properties and/or the structural integrity of the golf club head caused by recesses.

The foregoing description of the disclosed example embodiments is provided to enable any person of ordinary skill in the art to make or use the embodiments in the present disclosure. Various modifications to these examples will be readily apparent to those of ordinary skill in the art, and the principles disclosed herein may be applied to other examples without departing from the spirit or scope of the present disclosure. For example, in some embodiments, the indicia generation process described above can be applied to other parts of a golf club, such as a golf shaft to generate visually identifiable indicia defined by one or more roughened regions on the golf shaft.

Accordingly, the described embodiments are to be considered in all respects only as illustrative and not restrictive, and the scope of the disclosure is, therefore, indicated by the following claims rather than by the foregoing description. All changes which come within the meaning and range of equivalency of the claims are to be embraced within their scope.

What is claimed is:

1. A method comprising:

receiving a golf club head comprising a portion having a metal substrate layer and a sealant layer disposed thereon;

receiving a selection of a first indicia from among a plurality of indicia;

applying a masking to one or more exterior surface regions of the portion of the golf club head based on the selection; and generating a visual representation of the first indicia on an exterior surface of the portion by media blasting the portion of the golf club head, thereby forming a roughened region defining the first indicia within only the sealant layer, wherein the step of media blasting is carried out using media having a MOH Hardness no greater than 6.0.

2. The method of claim 1, wherein the portion comprises the top portion of the golf club head.

3. The method of claim 1, wherein the sealant layer comprises a thickness no greater than 200 μm.

4. The method of claim 1, wherein the sealant layer comprises a thickness between 20 μm and 60 μm.

5. The method of claim 1, wherein the sealant layer comprises a thickness, t, and a roughened region of the sealant layer comprises a maximum height Ry such that Ry is no greater than 0.6×t after media blasting the portion.

6. The method of claim 1, wherein a roughened region of the sealant layer comprises an average surface roughness, Ra, no less than 10 μm after media blasting the portion.

7. The method of claim 1, wherein the golf club head comprises a wood-type golf club head.

8. The method of claim 1, wherein the substrate layer comprises titanium or titanium alloy.

9. A method comprising:

receiving a golf club head comprising a portion having a metal substrate layer and a sealant layer disposed thereon;

receiving a selection of a first indicia from among a plurality of indicia;

applying a masking to one or more exterior surface regions of the portion of the golf club head based on the selection; and generating a visual representation of the first indicia on an exterior surface of the portion by media blasting the portion of the golf club head, thereby forming a roughened region defining the first indicia within only the sealant layer, wherein the step of media blasting is carried out using glass beads.

10. A method comprising:

receiving a golf club head comprising a portion having a metal substrate layer and a sealant layer disposed thereon;

receiving a selection of a first indicia from among a plurality of indicia;

applying a masking to one or more exterior surface regions of the portion of the golf club head based on the selection; and generating a visual representation of the first indicia on an exterior surface of the portion by media blasting the portion of the golf club head, thereby forming a roughened region defining the first indicia within only the sealant layer, wherein the step of media blasting occurs at a blast pressure of no greater than 60 psi.

* * * * *